United States Patent [19]

Philberth et al.

[11] 4,357,587

[45] Nov. 2, 1982

[54] CORE LAMINATIONS, PARTICULARLY FOR TRANSFORMERS

[75] Inventors: Karl Philberth; Bernhard Philberth, both of Puchheim, Fed. Rep. of Germany

[73] Assignee: Wilfried Ernst Sawatzky, Victoria, Australia

[21] Appl. No.: 146,590

[22] Filed: May 5, 1980

[30] Foreign Application Priority Data

Feb. 14, 1980 [DE] Fed. Rep. of Germany ..... 3005567

[51] Int. Cl.[3] ..... H01F 27/24

[52] U.S. Cl. ..... 336/212; 336/217

[58] Field of Search ..... 336/165, 217, 212, 216, 336/234, 178

[56] References Cited

U.S. PATENT DOCUMENTS

| | | | |
|---|---|---|---|
| 2,143,745 | 1/1939 | Sola | 336/165 X |
| 2,489,977 | 11/1949 | Porter | 336/218 X |
| 2,806,199 | 9/1957 | Sola | 336/165 X |
| 3,461,758 | 8/1969 | Michiulis | 336/212 X |
| 3,546,571 | 12/1970 | Fletcher et al. | 336/165 X |
| 4,149,136 | 4/1979 | Philberth et al. | 336/217 |
| 4,158,186 | 6/1979 | Philberth et al. | 336/217 |

OTHER PUBLICATIONS

"Technische Angabon zum PMz", Philberth, Feb. 1978.

*Primary Examiner*—Thomas J. Kozma

[57] ABSTRACT

Core laminations of the UI or EI type for iron cores, particularly for transformers, having two or three legs of equal length e and equal width f, spaced mutually apart by the same distance h, wherein the width $c_1$ of the jointlessly connecting yoke is greater than the width $c_2$ of the parted yoke, using the following dimensions: $1.1f \leqq c_1 \leqq 2.1f$ and $1.0f \leqq c_2 \leqq 1.5f$ and $0.1f \leqq c_1 - c_2 \leqq 0.6f$. Preferred dimensions for a waste-free UI shape and a suitable EI shape are: $c_1 = 1.4f$; $c_2 = h = 1.2f$; $e = 3.2f$. Preferred dimensions for a waste-free EI shape are: $c_1 = 1.5f$; $c_2 = h = 1.2f$; $e = 2.7f$.

11 Claims, 2 Drawing Figures

Fig.1
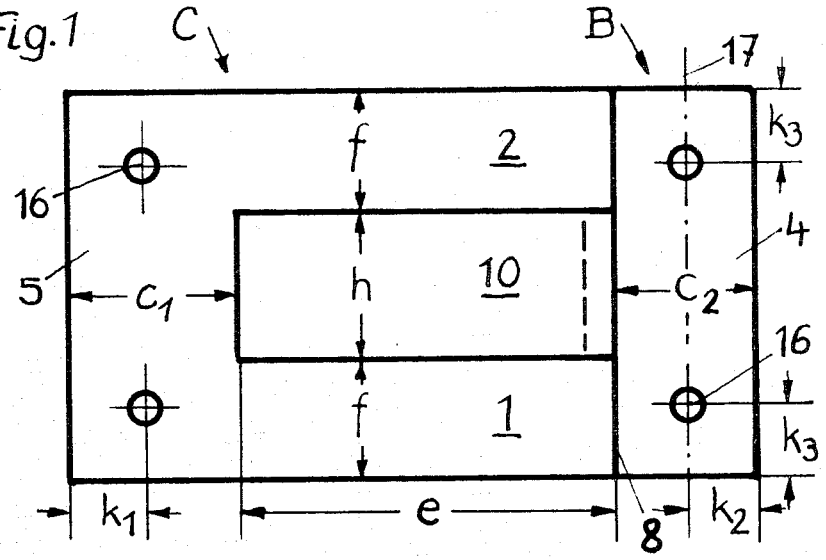
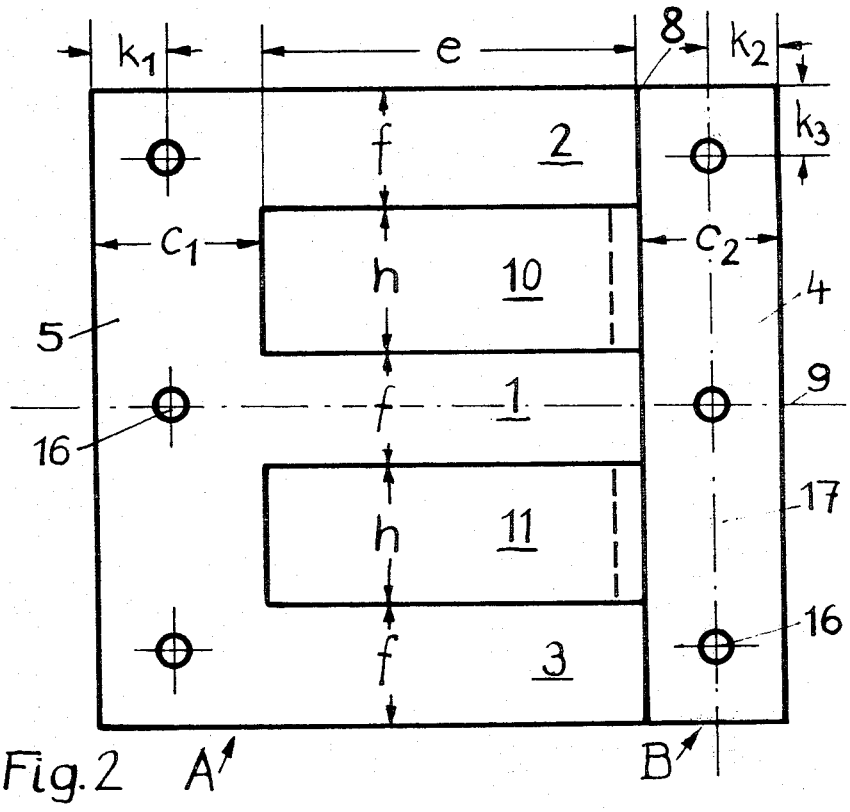
Fig.2

CORE LAMINATIONS, PARTICULARLY FOR TRANSFORMERS

The invention relates to core laminations for iron cores, particularly for transformers, consisting of a plurality of stacked core laminations, which core laminations have a maximum of three parallel spaced legs of equal length and two yokes connecting the ends of said legs, a joint being provided between one end of each leg and the adjacent yoke for interleaving in the winding, and the width of the jointlessly connecting yoke being greater than that of the parted yoke. This corresponds, so far, to an earlier patent application by the same applicant.

As a rule, the laminations in cores made of these known core laminations are stacked alternately, being arranged in the finished core in such a way that their outer edges always overlap in a common plane, which means that cores of this kind do not differ externally from customary types.

By virtue of the measures according to the above-named application the invention achieves the object of improving so-called M core laminations and so-called EI core laminations in such a way that in a shell-type core composed of these laminations, the more beneficial, jointless yoke cross-section is enlarged over the poorer, parted yoke cross-section, so reducing the reluctance and magnetic leakage and improving the efficiency.

The EI core laminations according to the above-named application are preferably constituted by types equivalent to M core laminations so that such cores can also be made with the ordinary coil formers taken for M cores like, for instance, the DIN M series.

There are, however, EI core laminations for cores having to windows, each of which is three times as long as, and as wide as, half the width of the centre leg. Proportioning the windows in this way gives a very good copper-to-iron relation in the transformer. EI core laminations proportioned in such a manner can be produced without wastage, by stamping the E members in pairs so that the window parts exactly form the I members. The latter thus have the same material graining as the legs, i.e. they are located in the preferred direction of magnetic flux, so making these EI core laminations more beneficial than M core laminations. Consequently, transformers having EI core laminations of such dimensions can be manufactured very economically, which is why these laminations have been standardized in the waste-free DIN EI series.

However, these EI core laminations still have drastic deficiencies, such as magnetic constrictions at the joints and poorly proportioned yokes and outer legs, which make the cost/benefit ratio needy of improvement. A further patent application, providing an optimum solution to the problem, sets out to remedy these deficiencies, while preserving the existing benefits.

Apart from the above-named M and EI core laminations, we additionally find so-called UI core laminations for single-phase transformers and so-called 3UI core laminations for three-phase transformers (these are EI core laminations but have different proportions in the form of legs of equal width). These core laminations are standardized in the DIN UI series and DIN 3UI series, respectively.

Here again, these core laminations, and the cores composed of them, exhibit quite severe reluctance at the joints and in the yokes, and hence are capable of improved efficiency. So-called Pu, Pl and Pu/Pl cores having strengthened yokes have in fact helped improve the magentic characteristics and the degree of efficiency, but they are still in need of improvement as regards the utilization of material and cannot be stamped without wastage.

The object of the invention is, therefore, to improve and optimize conventional UI core laminations and 3UI core laminations (EI types) so that the reluctance and the magnetic leakage are diminished, and the magnetic characteristics and degree of efficiency are improved, without having to abandon their inherent advantages. In particular, the invention sets out to improve and optimize the cost/benefit ratio by providing more beneficial winding proportions.

According to the invention this object is achieved in that, in UI core laminations or EI core laminations having legs of mutually equal width, the width $c_1$ of the jointlessly connecting yoke is at least 1.1 times, and at the most 2.1 times, the width f of each leg and in that the width $c_2$ of the parted yoke is at least 1.0 times, and at the most 1.5 times, the width f of each leg, such that the width $c_1$ of the jointlessly connecting yoke, minus the width $c_2$ of the parted yoke, is at least 0.1 times, and at the most 0.6 times, the width f of each leg ($1.1f \leqq c_1 \leqq 2.1f$ and $1.0f \leqq c_2 \leqq 1.5f$ and $0.1f \leqq c_1 - c_2 \leqq 0.6f$).

Beneficial proportions are obtained when the width $c_1$ of the jointlessly connecting yoke is at least 1.2 to a maximum of 1.7 times the width f of each leg and the width $c_2$ of the parted yoke is at least 1.1 to a maximum of 1.3 times the width f of each leg, so that the width $c_1$ of the jointlessly connecting yoke, minus the width $c_2$ of the parted yoke, is at least 0.1 to a maximum of 0.4 times the width f of each leg ($1.2f \leqq c_1 \leqq 1.7f$ and $1.1f \leqq c_2 \leqq 1.3f$ and $0.1f \leqq c_1 - c_2 \leqq 0.4f$).

Core laminations producing no waste at all can be manufactured by virtue of the measures according to this invention. This is achieved by the following additional features, which may also be used elsewhere to advantage.

The distance h between adjacent legs is equal to the width $c_2$ of the parted yoke, which means that UI core laminations can be stamped without wastage when the length e of each leg is additionally equal to the distance h between the two legs plus twice the width f of each leg ($h = c_2$ and $e = h + 2f$). Thus the window area cut from the U member exactly forms the I member.

These proportions (featuring $h = c_2$ and $e = h + 2f$) are, in fact, not completely waste-free with EI core laminations, i.e. 3UI types, and cause minor waste h.f, totalling a bare 5%, for each EI pair. Nonetheless these proportions are advantageous because they enable a three-phase EI transformer to be manufactured with the same coil formers and winding specifications as a UI transformer.

Coil formers having a gross spool length of 3 times the width f of each leg can be used when the length e of each leg is equal to the width $c_1$ of the jointlessly connecting yoke minus the width $c_2$ of the parted yoke plus 3 times the width f of each leg ($e = c_1 - c_2 + 3f$). Proportioning within the framework of conventional margins and tolerances enables DIN UI and DIN 3UI coil formers to be utilized.

Most favourable proportions are accomplished on this basis when, considered absolutely or approximately, the width $c_1$ of the jointlessly connecting yoke is 1.4 times, the width $c_2$ of the parted yoke is 1.2 times, and the length e of each leg is 3.2 times, the width f of each leg ($c_1=1.4f$ and $c_2=1.2f$ and $e=3.2f$).

This arrangement produces a gross ratio 3 of coil length to leg width, enabling DIN UI and DIN 3UI coil formers to be used. Additionally, this configuration creates a more favourable gross ratio 5 (instead of 6) of coil length to coil height and an equally more favourable gross ratio 0.6 (instead of 0.5) of coil height to leg width.

A waste-free EI core lamination having legs of equal width f is produced when the distance h between adjacent legs is equal to the width $c_2$ of the parted yoke and the length e of each leg is equal to the distance h plus 1.5 times the width f of each leg ($h=c_2$ and $e=h+1.5f$).

Most favourable proportions are accomplished on this basis when, considered exactly or approximately, the width $c_1$ of the jointlessly connecting yoke is 1.5 times, the width $c_2$ of the parted yoke is 1.2 times, and the length e of each leg is 2.7 times, the width f of each leg ($c_1=1.5f$ and $c_2=1.2f$ and $e=2.7f$). This arrangement produces a very beneficial gross ratio 4 of coil length to coil height and an equally favourable gross ratio 0.6 of coil height to leg width; moreover, this configuration features a core of square section.

These UI and EI core lamination proportions are most beneficial because the yoke cross-section, being larger than the leg cross-section by the factor $\frac{1}{2}(c_1+c_2)/f$, serves to improve and even optimize the magnetic characteristics, to diminish the losses and to create excellent cost/benefit ratios. Cores of this kind are such that they even require less magnetizing power than, for instance, continuous strip cores of the same leg cross-section and material. Major improvements are accomplished for grain-oriented material in which the preferred direction of magnetic flux is parallel to the legs and hence parallel to the yoke I member.

These proportions turn out extremely well even when they are judged merely against these basic demands for optimization. Over and above that, they additionally afford further advantages without requiring any extra expense or expenditure.

Firstly, the disturbance of the crystal structure along the stamped edges is of practically no consequence in the yokes because the latter are far wider than the width of the disturbed areas.

Secondly, mounting holes are practically unable to exert any detrimental influence because areas wider by about 10% to 30% are provided in the region of these holes.

Thirdly, the influence of joints in a core composed of alternately stacked laminations is considerably diminished by the fact that—since the leg ends are partly overlapped by adjacent laminations by the yoke width difference $c_1-c_2$—the undivided iron cross-section is $(\frac{1}{2}+\frac{1}{2}(c_1-c_2)/f)$ times the leg cross-section. A very substantial, additional benefit is achieved in conjunction with Goss grain-oriented material in particular, making this material of full profit for the first time ever; some of the flux is carried through the inner yoke parts of the width $c_1-c_2$ where the jointlessly connecting yokes inside the core are wider than the parted yokes, yet where the entire leg cross-section is still parallel to the preferred direction of flux. As a result, correspondingly reduced field density flows through the critical outer yoke parts of the width $c_2$ where half the cross-section is perpendicular to the preferred direction. In cores of tall design, the yoke thus works in regions of effectively far higher magnetizability.

Fourthly, curved I-member corners, having a radius smaller than the yoke width difference $c_1-c_2$, do not cause any magnetic constriction in cores of alternately stacked laminations. In contrast to DIN UI and DIN 3UI cores in which curves give rise to magnetic constriction, the core laminations of the invention provide for curved window corners. Curves of this kind (about 0.4 mm in radius) for the window corners and the corresponding I-member corners are very desirable because they help lengthen tool life.

It is advantageous when the distance $k_1$ between mounting holes in the jointlessly connecting yokes and the outer edge of this yoke is equal to the distance $k_2$ between mounting holes in the parted yoke and the outer edge of this yoke, where mounting holes in the parted yoke are advantageously located along the centre line of this yoke ($k_1=k_2=\frac{1}{2}c_2$). This configuration has a beneficial magnetic effect and avoids manufacturing difficulties due to the erroneous substitution of one side for the other.

It is additionally advantageous when corner mounting hole locations are spaced apart from the side edges by distances $k_3$ equal either to half the width $c_2$ of the parted yoke or to half the width f of each leg ($k_3=\frac{1}{2}c_2$ or $k_3=\frac{1}{2}f$). The former requires the least magnetizing power whereas the latter provides reduced magnetic leakage.

Two embodiments of the invention are represented in plan views in the drawing, in which the dash-dot line denotes the inner edge of the jointlessly connecting yoke of an alternately stacked core lamination below.

The embodiments according to FIG. 1 and FIG. 2 show very beneficial UI core laminations (FIG. 1) and EI core laminations (FIG. 2), respectively having two and three legs 1, $\frac{1}{3}$ of equal width f and featuring a jointlessly connecting yoke 5 of greater width $c_1$ than the width $c_2$ of the parted yoke 4.

In these embodiments the width $c_1$ of the jointlessly connecting yoke is 1.4 times the width f of each leg ($1.1f \leqq c_1 \leqq 2.1f$ yet preferably $1.2f \leqq c_1 \leqq 1.7f$); the width $c_2$ of the parted yoke is 1.2 times the width f of each leg ($1.0f \leqq c_2 \leqq 1.5f$ yet preferably $1.1f \leqq c_2 \leqq 1.3f$); the yoke width difference $c_1-c_2$ is 0.2 times the width f of each leg ($0.1f \leqq c_1-c_2 \leqq 0.6f$ yet preferably $0.1f \leqq c_1-c_2 \leqq 0.4f$); and the distance h of one leg from the next leg is equal to the width $c_2$ of the parted yoke. In both embodiments according to FIG. 1 and FIG. 2 the length e of each window is not only equal to this distance h plus twice the width f of each leg ($e=h+2f$) but also equal to the yoke width difference $c_1-c_2$ plus three times the width f of each leg ($e=c_1-c_2+3f$); put in concrete terms, this is $e=3.2f$.

The embodiment according to FIG. 1 shows a UI section which can be stamped without wastage. The embodiment according to FIG. 2 represents an EI section, which, though it cannot be fully stamped without wastage, forms—together with the legs 1 and 2 on the one hand and 2 and 3 on the otherhand with the joining yoke parts 5 and 4—a UI shape equivalent to the embodiment of FIG. 1, with the result that use may be made of identical coil formers and identical coil specifications. In particular, use may be made of DIN UI coil formers, with which an additional coil height reserve (of 0.1f) is advantageously obtained.

An embodiment showing waste-free EI core laminations is obtained when each leg is of length e, shortened—as compared with the embodiment of FIG. 2—by half the width f of each leg; $e=h+1.5f$ denoted by $e=2.7f$. An embodiment of a waste-free EI shape having a square section and an extremely good cost/-benefit ratio is obtained when, moreover, the width $c_1$ of the jointlessly connecting yoke 5 is equal to 1.5 times the width f of each leg. This waste-free stamping process produces two E members at a time, abutting in pairs at their leg ends and forming I members from their common windows.

The embodiments of FIG. 1 and FIG. 2 shows mounting holes 16 spaced apart from the outer edges by the distances $k_1$ and $K_2$ and $k_3$, respectively, which are all equal to half the width $c_2$ of the parted yoke 4 ($k_1=k_2=k_3=\frac{1}{2}c_2$). The embodiment of FIG. 2 additionally shows two mounting holes which are located along the centre line 9 of the centre leg 2, spaced apart from the outer yoke edges by the same distance $\frac{1}{2}c_2$.

I claim:

1. Core laminations for iron cores, particularly for transformers, comprising a plurality of stacked core laminations, said core laminations provided with legs having a maximum of three parallel spaced legs of equal length and of substantially equal width and two yokes connecting the ends of said legs, a joint being provided between one end of each leg and the adjacent yoke for interleaving in the winding, and the width of the jointlessly connecting yoke being greater than the parted yoke, wherein, the width ($c_1$) of the jointlessly connecting yoke (5) is at least 1.2 times, and at the most 1.7 times, the width (f) of each leg (1,2 or 3) and wherein the width ($c_2$) of the parted yoke (4) is at least 1.1 times, and at the most 1.3 times, the width (f) of each leg (1,2 or 3), such that the width ($c_1$) of the jointlessly connecting yoke (5) minus the width ($c_2$) of the parted yoke (4) is at least 0.1 times, and at the most 0.4 times, the width (f) of each leg (1,2 or 3) ($1.2f \leqq c_1 \leqq 1.7f$ and $1.1f \leqq c_2 \leqq 1.3f$ and $0.1f \leqq c_1-c_2 \leqq 0.4f$).

2. Core laminations forming an iron core, particularly for transformers, comprising a plurality of said core laminations stacked alternatingly reversed, said core laminations provided with legs having a maximum of three parallel spaced legs of equal length and of substantially equal width and two yokes connecting the ends of said legs, joints being provided, one each between one end of each leg and the adjacent yoke for insertion of the windings into winding spaces, and the width of the jointlessly connecting yoke being greater than the parted yoke, wherein the width ($c_1$) of the jointlessly connecting yoke (5) is at least 1.2 times, and at most 1.7 times, the width (f) of each leg (1,2 or 3) and wherein the width ($c_2$) of the parted yoke (4) is at least 1.1 times, and at most 1.3 times, the width (f) of each leg (1,2 or 3), such that the width ($c_1$) of the jointlessly connecting yoke (5) minus the width ($c_2$) of the parted yoke (4) is at least 0.1 times, and at the most 0.4 times, the width (f) of each leg (1,2 or 3) ($1.2f \leqq c_1 \leqq 1.7f$ and $1.1f \leqq c_2 \leqq 1.3f$ and $0.1 \leqq c_1-c_2 \leqq 0.4f$, and wherein in said plurality of said laminations alternatingly reversed the inside edges of said parted yoke are spaced away from said winding spaces in contrast to the inside edges of said jointlessly connecting yoke, with the inside edges of said parted yoke spaced from the inside edges of said jointlessly connecting yoke and the jointlessly connecting yoke inner edges nearer the winding spaces than the inside edges of said parted yoke, and said joints are located inside the yokes of said core.

3. Core laminations as defined in claim 1, wherein the distance (h) between adjacent legs is equal to the width ($c_2$) of the parted yoke (4) and wherein the length (e) of each leg (1, 2 or 3) is equal to the distance (h) plus twice the width (f) of each leg ($h=c_2$ and $e=h+2f$).

4. Core laminations as defined in claim 3, wherein the length (e) of each leg (1,2 or 3) is substantially equal to the width ($c_1$) of the jointlessly connecting yoke (5) minus the width ($c_2$) of the parted yoke (4) plus three times the width (f) of each leg ($e=c_1-c_23f$).

5. Core laminations as defined in any one of claims 1, 3, 4 or 2 wherein, the width ($c_1$) of the jointlessly connecting yoke (5) is 1.4 times, the width ($c_2$) of the parted yoke (4) is 1.2 times, and the length (e) of each leg (1,2 or 3) is 3.2 times, the width (f) of each leg ($c_1=1.4f$ and $c_2=1.2f$ and $e=3.2f$).

6. Core laminations as defined in any one of claims 1, or 2, wherein the distance (h) between adjacent legs is equal to the width ($c_2$) of the parted yoke (4) and wherein the length (e) of each leg (1,2 or 3) is equal to the distance (h) plus 1.5 times the width (f) of each leg ($h=c_2$ and $e=h+1.5f$).

7. Core laminations as defined in any one of claims 1 or 2, wherein, the width ($c_1$) of the jointlessly connecting yoke (5) is 1.5 times, the width ($c_2$) of the parted yoke (4) is 1.2 times, and the length (e) of each leg (1,2 or 3) is 2.7 times, the width (f) of each leg ($c_1=1.5f$ and $c_2=1.2f$ and $e=2.7f$).

8. Core laminations as defined in any one of claims 1, 3, 4 or 2, wherein corners of the parted yoke (4) and the window corners located at the jointlessly connecting yoke (5) are curved at a radius that is preferably smaller than the yoke width difference ($c_1-c_2$).

9. Core laminations as defined in any one of claims 1, 3, 4 or 2, wherein the distance ($k_1$) between the mounting holes (16) of the jointlessly connecting yoke (5) and the outer edge of this yoke is the same as the distance ($k_2$) between the mounting holes (16) of the parted yoke (4) and the outer edge of this yoke, where the mounting holes in the parted yoke are located along the center line (17) of this yoke ($k_1=k_2=\frac{1}{2}c_2$).

10. Core laminations as defined in any one of claims 1, 3, 4 or 2, wherein the corner mounting hole locations are spaced apart from the side edges by distance ($k_3$) equal either to half the width ($c_2$) of the parted yoke (4) or to half the width (f) of each leg (1,2 or 3) ($k_3=\frac{1}{2}c_2$ or $k_3=\frac{1}{2}f$).

11. Core laminations as defined in claim 2 wherein said joints are being overlapped by the adjacent jointlessly connecting yoke by the difference in widths of the two yokes ($c_1-c_2$).

* * * * *